US005464162A

United States Patent [19]

Kusters

[11] Patent Number: 5,464,162

[45] Date of Patent: Nov. 7, 1995

[54] DEVICE FOR REDUCING PAPER, IN PARTICULAR VALUABLE PAPERS

[75] Inventor: Wilhelmus M. A. Kusters, Venlo, Netherlands

[73] Assignee: Kusters Engineering B.V., Venlo, Netherlands

[21] Appl. No.: 233,625

[22] Filed: Apr. 26, 1994

[30] Foreign Application Priority Data

Apr. 26, 1993 [NL] Netherlands ..... 9300706

[51] Int. Cl.[6] ..... B02C 9/04; B02C 23/20; B02C 23/08

[52] U.S. Cl. ..... 241/36; 241/60; 241/63; 241/79.1; 241/152.2; 241/223

[58] Field of Search ..... 241/49, 57, 60, 241/62, 36, 63, 79.1, 152.2, 186.35, 223

[56] References Cited

U.S. PATENT DOCUMENTS

| | | | |
|---|---|---|---|
| 1,840,749 | 1/1932 | Stresau | 241/186.35 X |
| 2,095,385 | 10/1937 | Heisserman | 241/186.35 X |
| 2,435,927 | 2/1948 | Manning et al. | 241/79.1 X |
| 3,326,477 | 6/1967 | Demetrourts | 241/60 |
| 3,636,864 | 1/1972 | Loscialo | 241/60 X |
| 3,807,646 | 4/1974 | Leiter et al. | 241/60 |
| 4,011,999 | 3/1977 | Glaeser | 241/186.35 X |
| 4,061,274 | 12/1977 | Williams | 241/79.1 X |
| 4,809,915 | 3/1989 | Koffsky et al. | 241/36 |
| 5,386,944 | 2/1995 | Knepler et al. | 241/36 X |

FOREIGN PATENT DOCUMENTS

| | | | |
|---|---|---|---|
| 26435 | 2/1954 | Finland | 241/60 |
| 3612431A1 | 10/1987 | Germany | B02C 18/44 |
| 2198681 | 6/1988 | United Kingdom | B26D 1/24 |

*Primary Examiner*—Timothy V. Eley
*Attorney, Agent, or Firm*—Seed and Berry

[57] ABSTRACT

A device for reducing paper, in particular valuable papers, such as bank notes, said device being provided with a reducing device as well as with a conveyor belt for supplying the paper to the reducing device, whereby the at least substantially horizontally extending conveyor belt is supported by a cabinet-like frame, which accommodates the reducing device, which is at least largely positioned under said conveyor belt. The discharge end of the conveyor belt is positioned above an opening provided in an upper wall of the cabinet-like frame, under which said reducing device is positioned.

12 Claims, 1 Drawing Sheet

DEVICE FOR REDUCING PAPER, IN PARTICULAR VALUABLE PAPERS

TECHNICAL FIELD

The invention relates to a device for reducing paper, in particular valuable papers, such as bank notes, said device being provided with a reducing device as well as with a conveyor belt for supplying the paper to the reducing device, whereby the at least substantially horizontally extending conveyor belt is supported by a cabinet-like frame, which accommodates the reducing device, which is at least largely positioned under said conveyor belt.

BACKGROUND OF THE INVENTION

From GB-A-2198681 a device for reducing paper is known, wherein the paper to be shredded is passed, via a conveyor belt 50, between two rollers provided with cutting blades, one roller being disposed above the other. When this known device is used for reducing a relatively thick bundled stack of papers, such as for example a bundled stack of bank notes, this bundle will become stuck between the rollers provided with cutting blades. The conveyor belt will push more and more paper against the rollers, which will even accelerate the jamming of the rollers.

SUMMARY OF THE INVENTION

The object of the invention is to provide a device for reducing paper, which has a compact construction and which is suitable for shredding relatively thick bundles of paper.

In order to achieve this objective the invention is characterized in that the discharge end of the conveyor belt is positioned above an opening provided in an upper wall of the cabinet-like frame, under which said reducing device is positioned.

The reducing device is provided with two rollers provided with cutting blades, which are arranged in side-by-side relationship under the opening provided in the frame, whereby the central axes of the rollers lie in a plane which is substantially parallel to the horizontal conveyor belt. Bundles of paper supplied by means of the conveyor belt fall through the opening onto the rollers provided with cutting blades. The force of gravity will push the stacks against the rollers, whereby the cutting blades of the rollers cut off as much paper from the bundles as possible. The rest of the bundle of paper will remain behind on the rollers or is moved into another position with respect to the rollers as a result of the movement of said rollers, until also this paper is shredded by the rollers. As a result of the force of gravity an even force will be exerted on the entire bundle of paper, in the direction of the rollers.

When valuable papers, such as for example bank notes, are destroyed it is customary to count these bank notes first and then bundle them into stacks of for example one thousand notes. This because it is much more difficult to steal a bundled stack of bank notes than a single note. The bundled stack of bank notes is fed to the device, which will shred the entire stack.

Another advantage of the device according to the invention is that the entire reducing device is arranged within the cabinet-like frame and that no moving and cutting parts project above the conveyor belt, as a result of which no separate safety measures have to be taken.

It is noted that a device for reducing paper is known inter alia from German Patent Application No. 3612431, wherein the paper to be destroyed is supplied, for example by means of an upwardly sloping conveyor belt, to the upper side of a reducing device taking up a comparatively great height. This is partly caused by the fact that several parts of the reducing device are positioned one above the other.

It has become apparent that these known devices do not satisfy the need for devices of only a limited capacity, which have a compact construction which takes up little space.

One embodiment of the device according to the invention is characterized in that said reducing device comprises a pre-cutting device and a main cutting device, which are arranged in side-by-side relationship.

The pre-cutting device will cut up the paper to be reduced into strips, whilst the main cutting device will cut up the strips into shreds. Because the pre-cutting device and the main cutting device are arranged in side-by-side relationship under the conveyor belt, a compact construction is obtained.

BRIEF DESCRIPTION OF THE DRAWINGS

The invention will be explained in more detail hereafter with reference to an embodiment of a device according to the invention diagrammatically illustrated in the accompanying Figures.

DETAILED DESCRIPTION OF THE INVENTION

Figure 2:
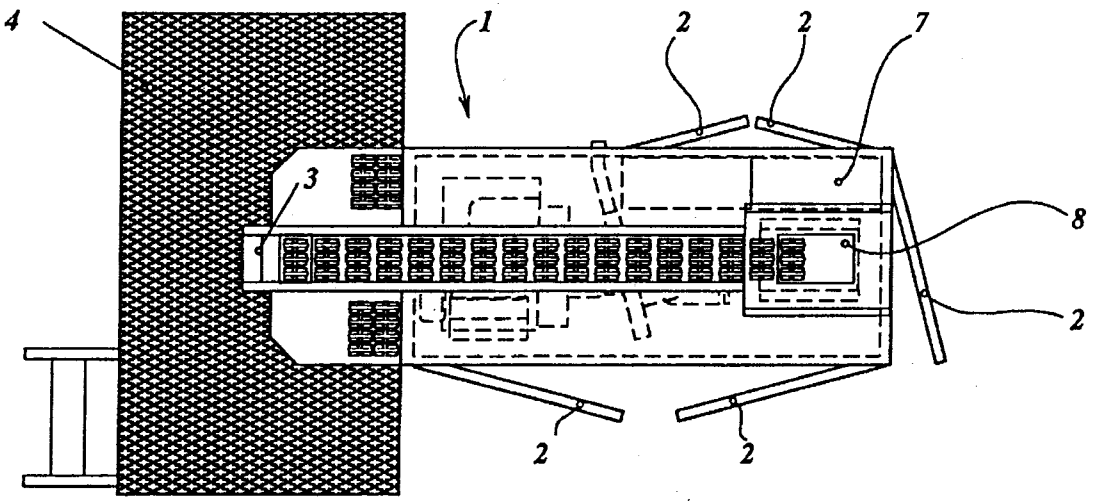
FIG. 2 is a plan view of FIG. 1.

The device shown in the Figures comprises a cabinet-like frame 1, whose interior can be accessed through doors 2 provided at the sides and at one end.

A horizontally extending conveyor belt 3 is supported on the upper side of the cabinet-like frame 1, said conveyor belt with one end extending above a platform 4, on which operating staff may take position.

The conveyor belt 3 is surrounded by a casing 5, which is preferably made of a transparent material. In the upper side of the cabinet 5, in the end extending above the platform, an opening is provided, which may be closed by means of a cover 6.

The end of the conveyor belt 3 remote from the platform is positioned above an opening 8 provided in the upper wall 7 of the cabinet-like frame 1.

A pre-cutting or pre-reducing device 9 forming part of the reducing device, which may have a construction known per se (for example as shown in DE 3612431) and by means of which paper fed to the device can be cut up into small strips, is provided under the opening 8.

The pre-cutting device is connected, via a duct 10, to a main cutting or main reducing device 11 likewise forming part of the reducing device, which may also have a construction known per se (for example as shown in DE 3612431) and by means of which paper fed to the device from the pre-cutting device can be cut up into very small pieces.

Figure 3:
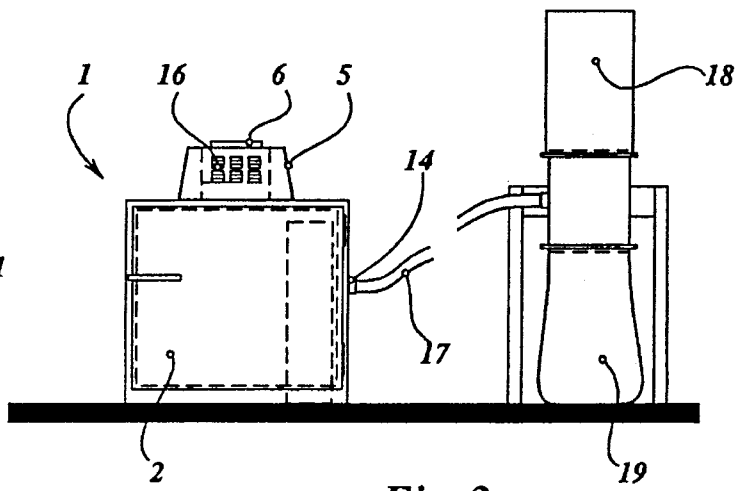
FIG. 3 is a side view of the device of FIG. 1, beside which a bagging device is disposed.

The discharge side of the main cutting device is connected to a fan 13 via a duct 12. The discharge duct 14 of the fan leads to one side of the cabinet-like frame 1 (FIG. 3).

Figure 1:
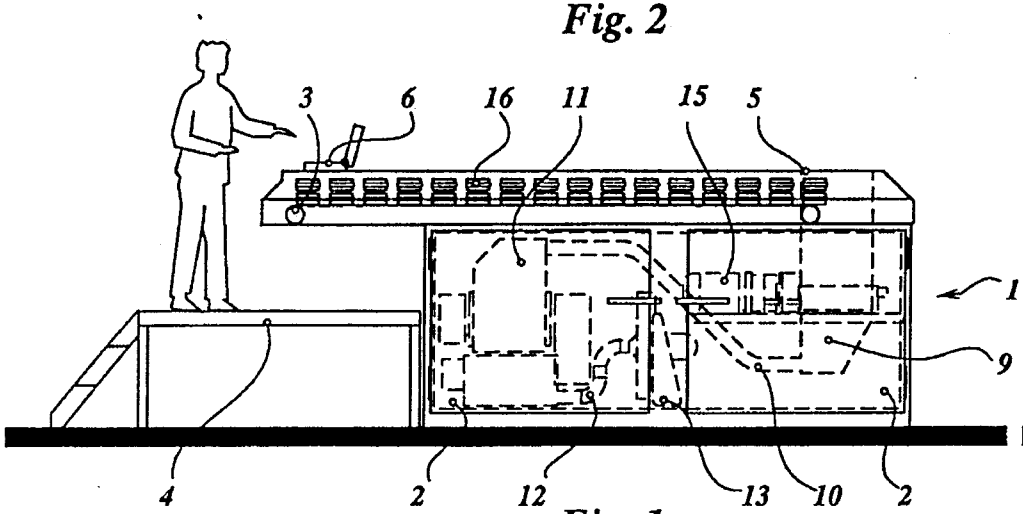
FIG. 1 is a side view of the device according to the invention.

As is apparent in particular from FIG. 1, the pre-cutting device 9 is positioned in such a manner that the driving mechanism 15 of the pre-cutting device, which inter alia comprises an electromotor, is positioned under the conveyor belt 3. Also the main cutting device 11 and the fan 13 are positioned under the conveyor belt. This makes it possible to achieve a very compact construction of the device according to the invention, whilst it is still possible to gain easy access to the cutting devices and the fan, and the parts associated therewith, via the doors 2 provided in the cabinet-like frame 1.

When the device is put into operation an operator may place bundles of valuable papers to be destroyed on the upper part of the conveyor belt 3 through the opening provided in the cabinet 5, after first having opened said opening, which is closed by the hatch 6. In the illustrated embodiment three bundles 16 can thereby be placed side by side on the conveyor belt through the opening. After three bundles have thus been placed on the conveyor belt 3, the upper part of the conveyor belt may be caused to move a predetermined step towards the right, seen in FIGS. 1 and 2, by operating a button or a switch after which a next number of bundles can be placed on the conveyor belt. Thus the entire upper part of the conveyor belt 3 may be filled, in the manner shown in FIGS. 1 and 2, with bundles of valuable papers or the like to be destroyed.

At a certain point, when the entire belt is filled, a number of bundles will fall into the pre-reducing device 9 from the right-hand end of the conveyor belt 3, which may be detected by means of a suitable sensor or the like, whereupon the pre-reducing device 9 will be put into operation, as will the final reducing device 11 and the fan 13.

When the pre-reducing device 9 is put into operation, the conveyor belt 3 will automatically be driven at a speed adapted to the processing capacity of the pre-reducing device 9, and the operator may continue to place paper to be destroyed on the left-hand end, seen in FIGS. 1 and 2, of the conveyor belt at a corresponding rate.

As long as paper to be destroyed keeps falling into the precutting or pre-reducing device 9, the device will continue to operate.

The paper falling into said pre-cutting device 9 will be cut up into pieces in the pre-cutting device, for example into small, ±20 mm wide strips. The rollers (not shown) provided with cutting blades of the precutting device are positioned under the opening 8 and are driven in opposite directions at a relatively low number of revolutions, as a result of which the bundles are cut up slowly but surely. This reduced material will be sucked from the pre-cutting device 9, through the duct 10, into the main cutting device 11 as a result of the sub-atmospheric pressure generated in the main cutting device 11 by means of the fan 13. A screen arranged near the exit of the pre-cutting device 9 prevents parts that are too large from landing in the main cutting device 11. In the main cutting device 11 the paper will be cut up further, for example into pieces of ±4×4 mm. The number of revolutions of the cutting drum (not shown) of the main cutting device is much higher than the number of revolutions of the rollers of the pre-cutting device, as a result of which the loose strips of paper are shredded in a very quick manner. Also the outlet of the main cutting device 11 is provided with a screen to prevent parts that are too large from exiting the main cutting device 11. The parts discharged from the main cutting device 11 by means of the fan 13 are blown out through the outlet duct 14.

As is shown in FIG. 3, the paper shreds that have been formed may be supplied, via a duct 17, to a cyclone 18, where the air is separated from the paper shreds and dust particles, after which the air can be exhausted and the paper shreds and dust particles can fall into the bag 19, which is positioned under the cyclone separator 18.

The bag 19 may for example be suspended from a weighing device, which stops the device when the contents inside the bag 19 have reached a predetermined weight, after which the filled bag may be exchanged for an empty bag and the device may be set in action again.

Instead of discharging the paper shreds in a bag it is also possible to feed them to a briquette-making device, where the paper shreds are pressed into a strand. As a result of this the volume of the paper shreds will be reduced considerably.

In order to avoid overloading of the device, it will be preferred to provide a current switch in the supply circuit of the driving mechanism for the pre-cutting device 9, which current switch turns off the current supply to the electromotor in case of overloading of the precutting device. Preferably the construction is thereby such that shortly after this switching-off has taken place the rotating parts of the precutting device are automatically driven to make a few revolutions in a direction opposed to the normal direction of rotation during operation, after which the normal operation is started again. Furthermore provisions may be made for the device to be turned off and a respective alarm signal to be given when such overloading of the pre-cutting device 9 occurs a few times shortly after each other.

It will be apparent that a simple and compact device has been obtained by using the construction according to the invention, by means of which valuable papers, such as bank notes and the like, can be destroyed in an effective manner.

We claim:

1. A device for reducing paper, in particular valuable papers, comprising:

a frame including an upper wall having an opening therein;

a substantially horizontal conveyor belt supported by the frame, the substantially horizontal conveyor belt having a discharge end above the opening; and a reducing device substantially contained in the frame, the reducing device including a pre-cutting device and a main cutting device in a substantially horizontal side-by-side relationship under the conveyor belt, the pre-cutting device being positioned below the opening.

2. A device according to claim 1 wherein the pre-cutting device has a driving mechanism positioned under the horizontal conveyor belt.

3. A device according to claim 2 wherein the reducing device includes a duct connecting the pre-cutting device to the main cutting device, and the main cutting device is connected to a fan.

4. A device according to claim 1 wherein the reducing device includes a duct connecting the pre-cutting device to the main cutting device, and the main cutting device is connected to a fan.

5. A device according to claim 4 wherein the fan is positioned under the horizontal conveyor belt and between the pre-cutting device and the main cutting device.

6. A device according to claim 4 wherein the fan has a discharge duct connected to a cyclone separating device, the cyclone separating device being beside the frame, and a bag is suspended under the cyclone separating device in a position to receive finely cut material from the cyclone separating device.

7. A device according to claim 6 wherein the cyclone separating device has a weighing device and the bag is suspended from the weighing device, the weighing device being adapted to turn off the reducing device when a predetermined weight of the bag and its contents is exceeded.

8. A device according to claim 1 wherein the frame is a closed cabinet and the conveyor belt is substantially surrounded by the closed cabinet, the closed cabinet having a closable opening adjacent to a supply end of the horizontal conveyor belt to provide access to the cabinet.

9. A device according to claim 1 further comprising means for moving the horizontal conveyor belt in steps during a process of loading the horizontal conveyor belt.

10. A device according to claim 1 wherein the horizontal conveyor belt is connected to a first drive mechanism, and the first drive mechanism is synchronized with a second drive mechanism of the pre-cutting device during normal operation of the reducing device.

11. A device according to claim 1 wherein the horizontal conveyor belt has a supply end that projects beyond the frame.

12. A device for reducing paper, in particular valuable papers, comprising:

a cabinet defining an interior area and including an upper wall having an opening therein providing access to the interior area;

a substantially horizontal conveyor belt supported by the upper wall of the cabinet, the substantially horizontal conveyor belt having a discharge end above the opening; and a reducing device in the interior area of the cabinet, the reducing device including a pre-cutting device and a main cutting device in a generally horizontal side-by-side relationship under the conveyor belt, the pre-cutting device being positioned below the opening to receive material from the discharge end of the horizontal conveyor.

* * * * *